US007833046B2

(12) United States Patent
Tamura et al.

(10) Patent No.: US 7,833,046 B2
(45) Date of Patent: Nov. 16, 2010

(54) ELECTRICAL CONNECTOR

(75) Inventors: Fuminobu Tamura, Tokyo (JP); Hiroyuki Yamazaki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 71 days.

(21) Appl. No.: 12/385,492

(22) Filed: Apr. 9, 2009

(65) Prior Publication Data

US 2009/0269971 A1 Oct. 29, 2009

(30) Foreign Application Priority Data

Apr. 24, 2008 (JP) ..... 2008-113310

(51) Int. Cl.
*H01R 4/24* (2006.01)

(52) U.S. Cl. ..... 439/422; 439/329

(58) Field of Classification Search ..... 439/422, 439/492, 499, 329, 260, 494, 495
See application file for complete search history.

(56) References Cited

U.S. PATENT DOCUMENTS 6,733,326 B2 * 5/2004 Lee ..... 439/495
6,773,287 B2 * 8/2004 Takashita ..... 439/260
7,083,455 B1 * 8/2006 Miura et al. ..... 439/260
7,134,891 B2 * 11/2006 Kayama et al. ..... 439/260
7,473,125 B2 * 1/2009 Murakami ..... 439/495

FOREIGN PATENT DOCUMENTS

JP 61-109083 U 7/1986
JP 5-94978 U 12/1993

OTHER PUBLICATIONS

Office Action of Japan Patent Office, Feb. 26, 2010.

* cited by examiner

*Primary Examiner*—Tho D Ta
*Assistant Examiner*—Travis Chambers
(74) *Attorney, Agent, or Firm*—Kubotera & Associates LLC

(57) ABSTRACT

An electrical connector to be connected to a flat conductive member includes a housing including an upper wall and a lower wall; a terminal including a contact portion for contacting with the flat conductive member; and an engaging protrusion for engaging the flat conductive member. The housing further includes a receptacle portion between the upper wall and the lower wall for receiving the flat conductive member. The upper wall includes a cut portion. The engaging protrusion is situated under the cut portion, so that an edge portion of the flat conductive member moves over the engaging protrusion and deforms into the cut portion when the flat conductive member is inserted into the receptacle portion.

9 Claims, 5 Drawing Sheets

ELECTRICAL CONNECTOR

BACKGROUND OF THE INVENTION AND RELATED ART STATEMENT

The present invention relates to an electrical connector to be connected to a flat conductive member.

Flexible printed circuit boards (FPC) and flat cables are known as flat conductive members. The flat conductive member is often connected to an electrical connector (connector) mounted on a circuit board. One of the conventional connectors connected to the flat conductive member, for example, is disclosed in a Japanese Patent Publication.

Patent Reference Japanese Patent Publication No. 61-109083

The conventional electrical connector (connector) disclosed in Patent Reference includes a housing with an opening having a horizontally long shape at a front side thereof as seen in a direction that the flat cable is inserted. The opening extends in the inserting direction of the flat cable and forms a hollow portion for receiving the flat cable. The hollow portion includes a protruding portion formed on a bottom surface at a far end portion thereof. The protruding portion is situated at a position corresponding to an edge of the flat cable in a width direction thereof. The protruding portion engages a cut portion formed in a side edge of the flat cable when the flat cable is inserted and settled at a given position.

An inner surface of an upper wall of the hollow portion includes a tapered surface at the edge in the width direction of the opening. An inclination of the tapered surface is reduced toward the far end portion of the hollow portion.

When the flat cable is inserted, the flat cable is deformed into a concaved shape at a front end portion thereof by pinching with fingers. Then, the front end portion of the flat cable is inserted into the hollow portion so as to follow the inner surface of the upper wall of the opening. Since the inclination at the either end of the inner surface of the upper wall is reduced toward the far end, the flat cable deforms from the concaved shape to a flat shape as the flat cable is inserted further. Thereby, the cut portion can engage with the protruding portion from an upper side after the cut portion moves over the protruding portion.

In the conventional connector described above, problems about a downsizing thereof and easiness of an operation thereof still remain. For example, though the upper wall of the hollow portion formed in the housing includes the tapered surface on the inner surface of the upper wall at the either end in the width direction, an upper portion of the housing remains over the tapered surface with a certain level of a thickness. As a result, it is difficult to downsize the housing in a height direction.

Further, the flat cable has to be pinched by fingers so that the flat cable can deform into the concaved shape. In addition, the concaved shape has to fit to a shape of the inner surface of the upper wall. As described above, it is difficult to operate the conventional connector.

In view of the problems described above, an object of the present invention is to provide an electrical connector to be connected to a flat conductive member, capable of downsizing in a height direction as well as being easy to operate.

Further objects and advantages of the invention will be apparent from the following description of the invention.

SUMMARY OF THE INVENTION

In order to attain the objects described above, according to the present invention, an electrical connector to be connected to a flat conductive member (connector) includes a housing including an upper wall and a lower wall. Further, the housing includes a receptacle portion between the upper wall and the lower wall for receiving the flat conductive member. The connector also includes a terminal including a contact portion for contacting with the flat conductive member. The terminal is aligned in the receptacle portion at a position contacting with the flat conductive member. In addition, the connector includes an engaging protrusion for engaging the flat conductive member. The flat conductive member includes an edge portion at a position corresponding to the engaging protrusion. When the flat conductive member is inserted into the receptacle portion, a rear end portion of the edge portion engages the engaging protrusion, thereby preventing the flat conductive member from coming off.

In the electrical connector to be connected to the flat conductive member, in the present invention, the upper wall of the housing includes a cut portion passing through the upper wall in a thickness direction thereof. Under the cut portion, the engaging protrusion is situated. When the edge portion of the flat conductive member is situated over the engaging protrusion, the edge portion of the flat conductive member can deform upward into the cut portion.

In the connector described above, the flat conductive member including the edge portion is inserted into the receptacle portion of the housing. As the edge portion of the flat conductive member reaches over the engaging protrusion, an edge portion deforms upward due to the engaging protrusion. Since the engaging protrusion is situated under the cut portion, the edge portion and an adjacent portion thereof can deform into the cut portion.

As the flat conductive member is inserted further, the edge portion of the flat conductive member moves over the engaging protrusion and is settled at a predetermined position. At the predetermined position, the edge portion is no longer situated over the engaging protrusion. Accordingly, the flat conductive member returns into a flat shape released from the deformation. As a result, the edge portion can engage the engaging protrusion, thereby preventing the flat conductive member from coming off when the flat conductive member is pulled in a rear direction, that is, in a direction of an extraction of the flat conductive member.

As described above, in the present invention, the edge portion of the flat conductive member can deform into the cut portion, in the thickness direction of the upper wall.

In the present invention, the engaging protrusion may be formed in a metal member attached to the housing. The engaging protrusion also may be formed on the lower wall of the housing. When the engaging protrusion is formed on the metal member, the engaging protrusion can obtain a sufficient strength with a relatively small area for engaging. When the engaging protrusion is formed on the lower wall of the housing, it is possible to reduce a number of components since the metal component is unnecessary.

In the present invention, it is preferred that the cut portion includes an oblique edge at an inner side edge thereof, inclined outward in a direction that the terminal is aligned relative to a direction that the flat conductive member is inserted into the receptacle portion. As the flat conductive member is inserted into the receptacle portion, the flat conductive member is guided through a sliding contact with the inner side edge. Consequently, the flat conductive member returns into a flat shape upon receiving a force downward at a deformed portion thereof.

In the present invention, it is preferred that the cut portion includes a tapered surface at a position where the side end edge is located. The tapered surface is inclined upward on a surface facing the lower wall thereof. In addition, the receptacle portion can be widened with the tapered surface. As a result, the flat conductive member can be smoothly inserted and proceed easily as an upper surface of the flat conductive member is guided by the tapered surface.

In the present invention, the engaging protrusion may be arranged so that a distance between the engaging portion and the upper wall is smaller than a thickness of the flat conductive member. Thereby, after the edge portion moves over the engaging protrusion, the flat conductive member does not move from a position engaging the engaging protrusion even though the flat conductive member is wobbled in the thickness direction thereof or up and down direction.

In the present invention, the cut portion may have a V character shape in a plan view. The inner side edge of the cut portion having the V shape can guide a deformed portion of the flat conductive member continuously as the flat conductive member is inserted.

In the present invention, the connector may include a pressing member supported so as to rotate. The pressing member moves and presses a portion of the terminal thereby increasing an elastic contacting force at the contact portion of the terminal against the flat conductive member.

The pressing member is operated after the flat conductive member is inserted to the predetermined position, thereby increasing the elastic contacting force at the contact portion of the terminal against the flat conductive member. As a result, the contact portion of the terminal and the flat conductive member can contact with each other more certainly. In other words, it is more effective to prevent the flat conductive member from displacement or coming off in a direction that the flat conductive member is inserted.

In the present invention, as described above, the connector includes the cut portion cut penetrating the upper wall in the thickness direction thereof. Further, the engaging protrusion engaging the edge portion of the flat conductive member is situated under the cut portion. Accordingly, when the flat conductive member is inserted into the receptacle portion, if the connector is downsized in a height direction, the flat conductive member has a sufficient space to deform upward into the cut portion as the edge portion is situated over the engaging protrusion. Thereby, it is effective to downsize the connector. In addition, when the flat conductive member is inserted into the receptacle portion, since the flat conductive member deforms automatically, the flat conductive member can be inserted without any deformation. Thus, the connector in the present invention is easy to operate as well.

Furthermore, when the flat conductive member is inserted completely, the flat conductive member returns into the flat shape released from the deformation and the edge portion can engage the engaging protrusion automatically. Accordingly, it is possible to prevent the flat conductive member from coming off more certainly.

BRIEF DESCRIPTION OF THE DRAWINGS

FIGS. 1(A) and 1(B) are views showing an electrical connector for a flat conductive member and the flat conductive member to be connected to the connector according to an embodiment of the present invention, wherein FIG. 1(A) is a perspective view showing the connector and the flat conductive member, and FIG. 1(B) is a partial plan view of the connector showing;

FIGS. 2(A) to 2(C) are sectional views showing the connector according to the embodiment of the present invention, wherein FIG. 2(A) is a sectional view taken along a line 2A-2A in FIG. 1(A), FIG. 2(B) is a sectional view taken along a line 2B-2B in FIG. 1(A) and FIG. 2(C) is a sectional view taken along a line 2C-2C in FIG. 1(A);

FIGS. 3(A) to 3(C) are sectional views taken along where a metal component is located showing a process of inserting the flat conductive member to the connector according to the embodiment of the present invention, wherein FIG. 3(A) is a sectional view before the flat conductive member is inserted to the connector, FIG. 3(B) is a sectional view when the flat conductive member is in the halfway of the insertion, and FIG. 3(C) is a sectional view when the flat conductive member is completely inserted;

FIGS. 4(A) and 4(B) are sectional views taken along where a terminal is located showing the connector when the flat conductive member is inserted thereto according to the embodiment of the present invention, wherein FIG. 4(A) is a sectional view when a pressing member is at an open position and FIG. 4(B) is a sectional view when the pressing member is at a closed position.

DETAILED DESCRIPTION OF THE PREFERRED EMBODIMENTS

Hereunder, embodiments of the present invention will be explained with reference to the accompanying drawings.

Figure 1A:
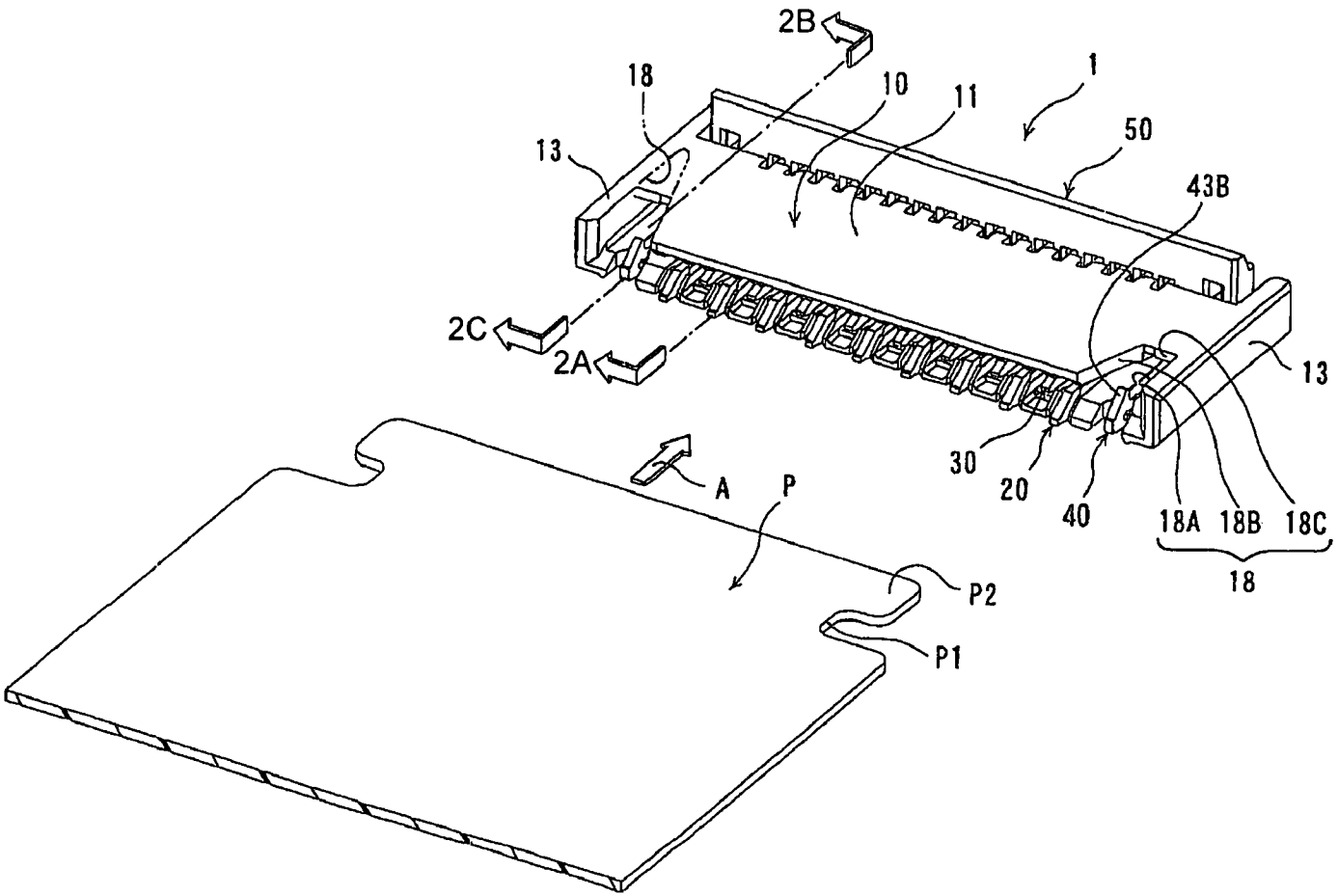
Figure 1B:
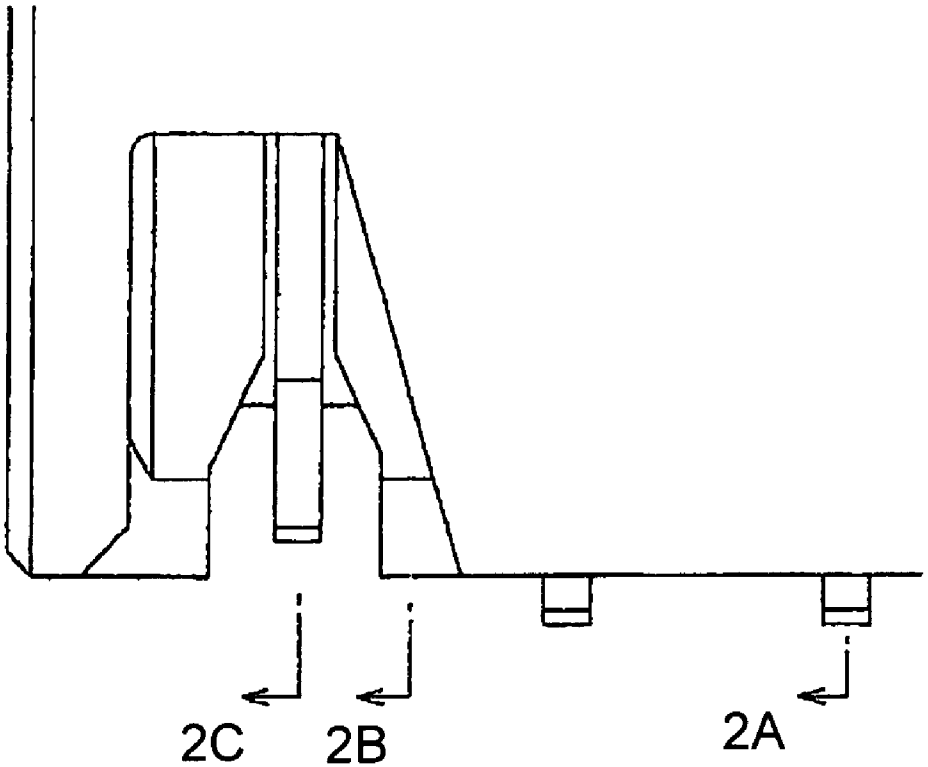
Figure 2A:
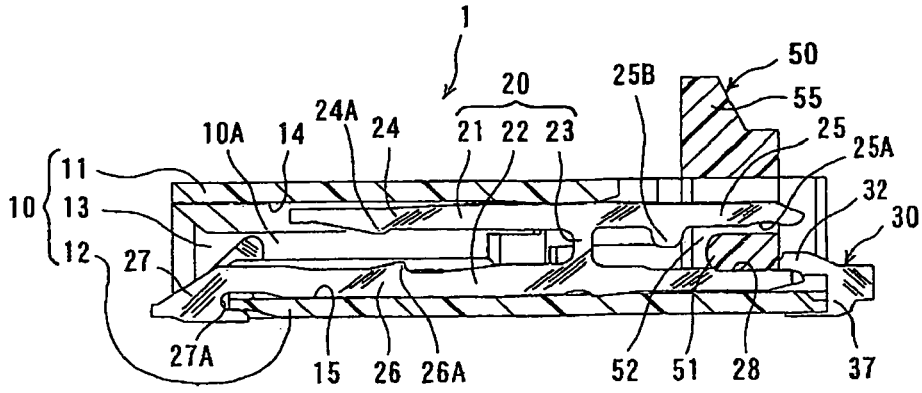
Figure 2B:
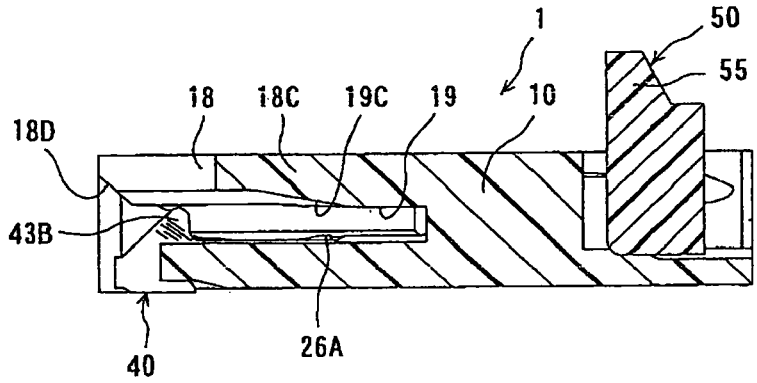
Figure 2C:
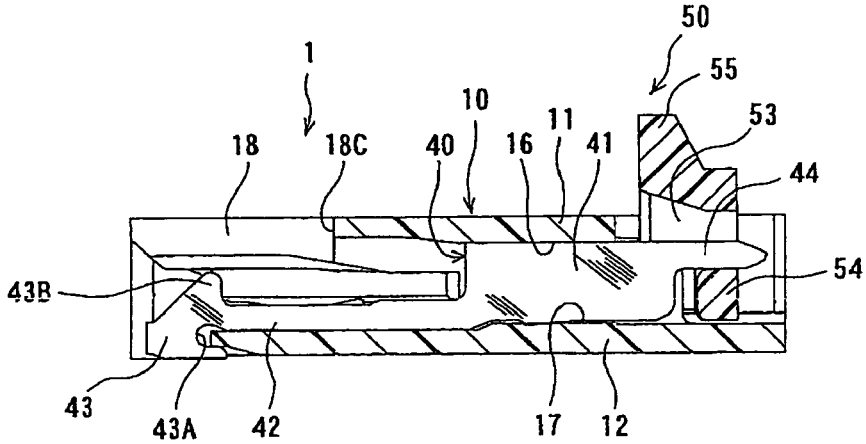

An electrical connector to be connected to a flat conductive member (connector) 1 shown in FIGS. 1(A) and 1(B) is mounted on a circuit board (not shown) according to the embodiment of the present invention. FIG. 1(A) is a perspective view showing the connector 1 and a flat conductive member P to be connected thereto, and FIG. 1(B) is an enlarged partial plan view showing positions of lines along which sectional views in FIGS. 2(A)-2(C) are taken.

The connector 1 shown in FIG. 1(A) includes a housing 10; two types of terminals, that is, a first terminal 20 and a second terminal 30 aligned and held alternately in the housing 10; a metal component 40 provided near the terminal at an end in a terminal aligning direction for a direction the terminals align; and a pressing member 50 supported by the housing 10 so as to rotate. The pressing member 50 is located at a front end side of the housing 10 and capable of rotating between an open position and a closed position. In FIG. 1(A), the pressing member 50 is at the open position. The housing 10 further includes an opening as a receptacle portion at a rear end side thereof. The flat conductive member P not yet inserted to the connector 1 is situated at a further back side of the housing 10.

The flat conductive member P is inserted in a direction of an arrow A (a front direction) shown in FIG. 1(A) to the connector 1 and connected thereto. The flat conductive member P includes a plurality of connection circuit portions (not shown) on an upper side thereof, in a direction perpendicular to the direction of the arrow A or a width direction thereof with a specific interval. The connection circuit portion may be formed only on the upper side, only on a lower side or on the both of the upper and lower sides.

The width of the flat conductive member P is slightly narrower at the front end side thereof. The flat conductive member P includes a narrow portion P1 being narrow and an edge portion P2 for engaging, extending toward the side end thereof between the narrow portion P1 and a front edge thereof.

FIGS. 2(A)-2(C), 3(A)-3(C), and 4(A)-4(B) are sectional views of the connector 1, taken along planes perpendicular to the terminal aligning direction according to the embodiment of the present invention. FIGS. 2(A), 2(B), and 2(C) are sectional views taken along lines 2A, 2B and 2C, respectively. In other words, FIG. 2(A) shows where the first terminal 20 is located; FIG. 2(B) shows between the first terminal 20 and the metal component 40; and FIG. 2(C) shows where the metal component 40 is located.

Figure 3A:
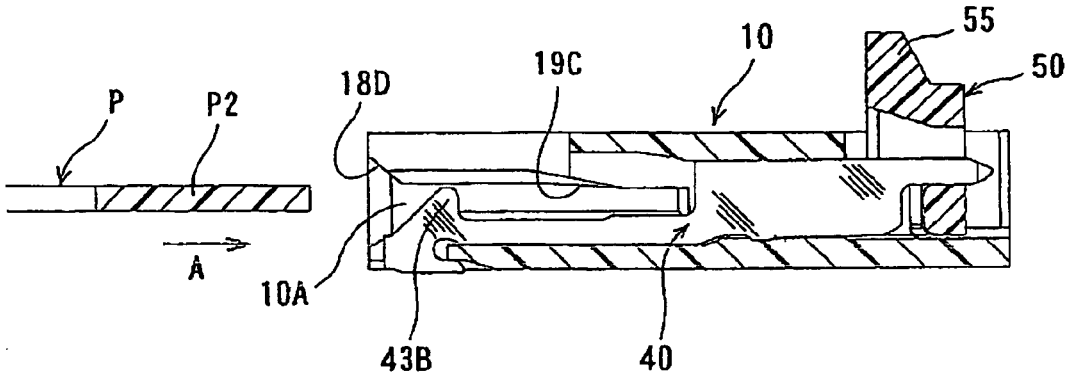
Figure 3B:
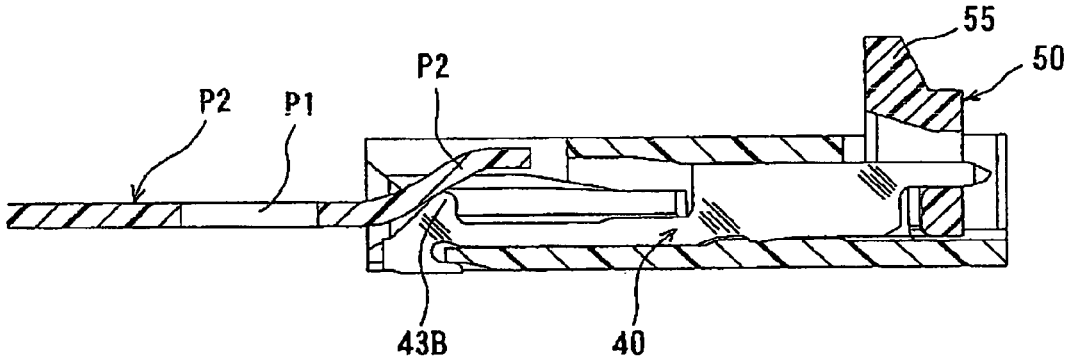
Figure 3C:
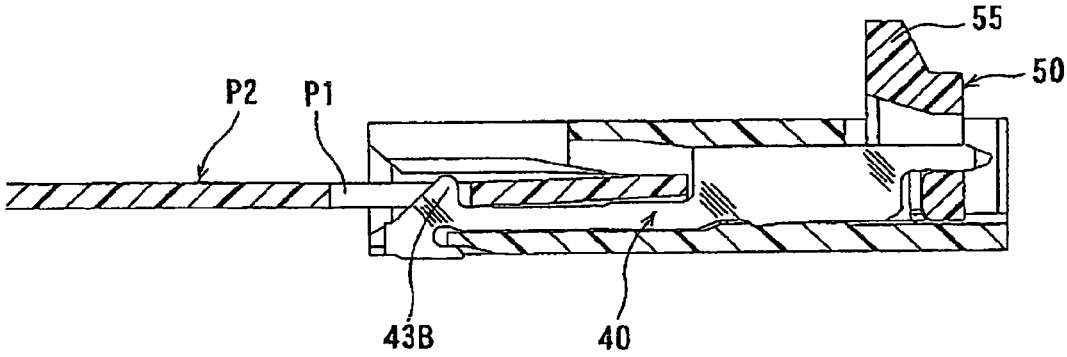
Figure 4A:
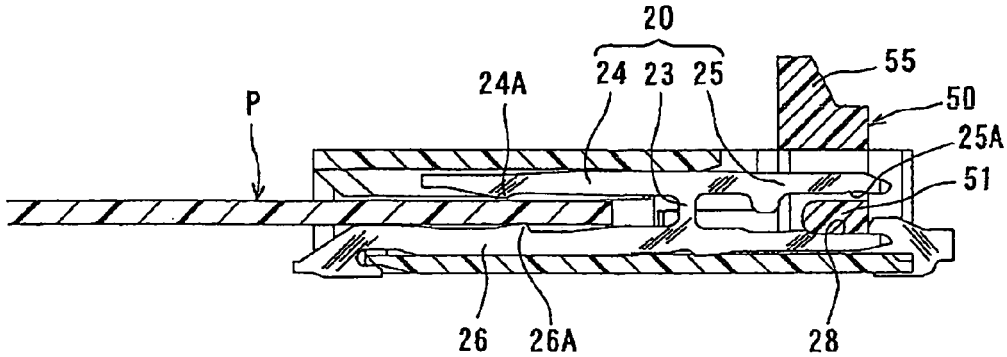
Figure 4B:
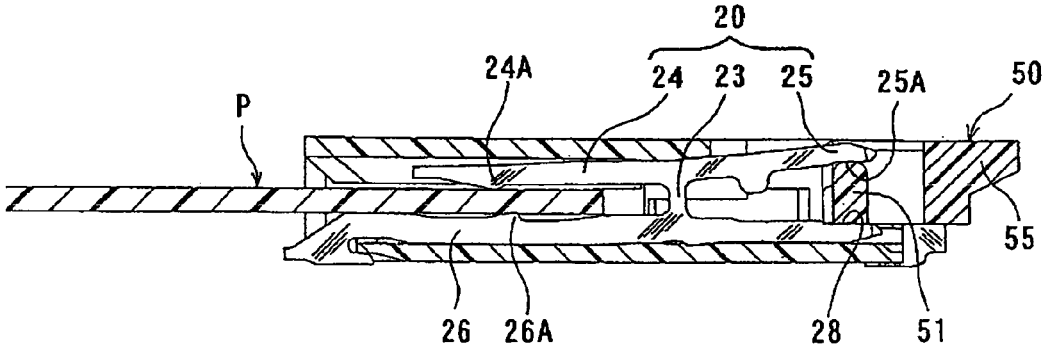

FIGS. 3(A)-3(C) show where the metal component 40 is located. FIG. 3(A) is a sectional view before the flat conductive member P is inserted to the connector 1; FIG. 3(B) is a sectional view when the flat conductive member P is in the halfway of the insertion to the connector 1; and FIG. 3(C) is a sectional view thereof when the insertion of the flat conductive member P to the connector 1 is completed. FIGS. 4(A) and 4(B) show where the first terminal 20 is located. FIG. 4(A) is a sectional view when the pressing member 50 is at the open position and FIG. 4(B) is a sectional view when the pressing member 50 is at the closed position.

The housing 10 is made from an electrical insulating material by molding integrally. The housing 10 includes an upper wall 11 and a lower wall 12. The upper wall 11 and the lower wall 12 are combined through side walls 13 at both ends thereof in a width direction (a direction perpendicular to the sheet in FIGS. 2(A)-2(C), 3(A)-3(C), and 4(A)-4(B)).

A receptacle portion 10A is formed with a space between the upper wall 11 and the lower wall 12. The receptacle portion 10A receives the flat conductive member P from the back side. As shown in FIGS. 2(A)-2(C), the space is formed penetrating the housing 10 in a front to rear direction (in FIGS. 2(A) and 2(C), a front side is right side while a rear side is left side). The upper wall 11 and the lower wall 12 include a terminal grooves 14 and 15 for holding the first and second terminals 20 and 30; and a metal component grooves 16 and 17 for holding the metal component 40 on surfaces facing each other, extending in the front to rear direction and having a specific interval in the width direction of the housing 10.

In the embodiment, the first terminal 20, the second terminal 30 and the metal component 40 are formed maintaining flat surfaces of metal plates. Accordingly, the terminal grooves 14 and 15, and the metal component groove 16 and 17 are formed to have widths nearly equal to thicknesses of the metal plates, respectively.

As shown in FIG. 2(A), the first terminal 20 has a laterally H character shape. The first terminal 20 includes an upper arm portion 21, a lower arm portion 22 and a combining portion 23. The upper arm portion 21 and the lower arm portion 22 are combined through the combining portion 23 at middle portions in a longitudinal direction thereof.

The upper arm portion 21 includes a contact arm portion 24 at the rear side from the combining portion 23 thereof and the contact arm portion 24 includes a contact portion 24A having a protruding shape at a lower edge thereof. The contact arm portion further includes a pressed arm portion 25 at the front side from the combining portion 23 thereof. The pressed arm portion 25 includes a pressed portion 25A with slightly recessed shape at a lower edge of a front edge side thereof. The upper arm portion 21 is aligned in the terminal groove 14 with a space increasing toward the rear side at an upper end thereof. As described later, when the pressed portion 25A receives a force upwardly by a cam portion of the pressing member 50, the pressed arm portion 25 deforms obliquely in an upper direction and the contact arm portion 24 deforms a rear end portion thereof obliquely in a lower direction, rotating around the combining portion 23 as a pivot. The pressed arm portion 25 of the upper arm portion 21 includes a position regulating portion 25B protruding in the lower direction at an intermediate position in the longitudinal direction thereof. As described later, the position regulating portion 25B prevents the cam portion of the pressing member 50 from moving toward the rear side from a predetermined position when the pressing member 50 is assembled from the front side to the rear side.

The lower arm portion 22 includes a contact arm portion 26 at the rear side from the combining portion 23 and the contact arm portion 26 includes a contact pressing portion 26A having a protruding shape at an intermediate portion in the longitudinal direction thereof. The contact arm portion 26 further includes a connecting portion 27 at a rear edge portion thereof. The contact portion 27 is located outside of the housing 10 and situated at a nearly the same level with or a slightly lower position than a bottom surface of the housing 10. The contact portion 27 includes a fixing groove 27A opening in the front direction.

Further, the lower arm portion 22 includes a cam supporting portion 28 at an upper edge of a front side from the combining portion 23 thereof. The cam supporting portion 28 forms a portion for supporting rotation of the cam portion of the pressing member 50.

The first terminal 20 described above is inserted into the housing 10 from the rear side to the front side. The upper arm portion 21 and the lower arm portion 22 are placed in the terminal groove 14 of the upper wall 11 and the terminal groove 15 of the lower wall 12, being retained with a press-fitting force between the terminal grooves 14 and 15, respectively. The first terminal 20 is also retained as the fixing groove 27A formed at the contact portion 27 of the lower arm portion 22 engages with a rear end edge of the lower wall 12.

The second terminal 30 is aligned alternately with the first terminal 20 in a terminal-aligning area.

The second terminal 30 has the same shape with the first terminal 20, except that a contact portion 37 and a fixing groove 37A are located at a front end side thereof while the contact portion 27 and the fixing groove 27A are located at the rear end side of the first terminal 20. Therefore, the second terminal 30 is placed on the terminal grooves (not shown) of the housing 10 from the rear side and retained. The fixing groove 37A retains the second terminal 30 by engaging with a front end edge of the lower wall 12.

The metal component 40 is placed at an either edge of the terminal-aligning area, where the first terminal 20 and the second terminal 30 are aligned alternately in the terminal-aligning direction. The metal component 40 is placed parallel to the first and second terminals 20 and 30 and is formed maintaining the flat surface of the metal plate as well as the first and second terminals 20 and 30.

As shown in FIG. 2(C), the metal component 40 includes a held portion 41 and a fixing arm portion 42. The held portion 41 is held by the metal component grooves 16 and 17 formed in the upper wall 11 and the lower wall 12, respectively. The fixing arm portion 42 is located at the rear side of the held portion 41 and fixed to the metal component groove 17 of the lower wall 12. The fixing arm portion 42 includes an engaging protrusion 43B protruding upward at a rear end side thereof and a fixing portion 43 at a lower side of the engaging protrusion 43B. The fixing portion 43 includes a fixing groove 43A for engaging with the rear end edge of the lower wall 12 of the housing 10. The metal component 40 further includes a supporting arm 44 extending from a front end of an upper side of the held portion 41 in the front direction. The supporting arm 44 forms a space for placing a shaft portion of the pressing member 50 with the lower wall 12. As the metal component 40 is inserted into the housing 10 from the rear side to the front side, the held portion 41 is press-fitted and held in the metal component groove 16 in the upper wall 11 and the metal component groove 17 in the lower wall 12. Further, the fixing arm portion 42 is placed in the metal component groove 17 and the engaging protrusion 43B protrudes by a large amount upwardly from the metal component groove 17. The engaging protrusion 43B has a shape having a front edge extending in an upright direction and a rear edge having a tapered shape. The fixing groove 43A formed in the fixing portion 43 located at the lower side of the engaging protrusion 43B engages with a rear end edge of the lower wall 12, thereby retaining the metal component 40.

As shown in FIG. 1(A), the upper wall 11 of the housing 10 is cut in a range of a whole width at a front end edge thereof in order to provide a space for the pressing member 50. In addition, the upper wall 11 includes a cut portion 18 cut from the rear end edge toward the front at the either end in the width direction of the rear end edge side thereof. As it is obvious in FIG. 1(A), the cut portion 18 is formed with a straight edge 18A; an oblique edge 18B; and a front end edge 18C. The straight edge 18A extends straight to the front at an outer side in the width direction, in other words, at a side closer to the side wall 13, the oblique edge 18B is located at an inner side in the width direction and extends outward inclined relative to a direction that the flat conductive member is inserted into the receptacle portion, and the front end edge 18C extends in the width direction. The cut portion 18 is cut so as to penetrate the upper wall 11 completely in a thickness direction thereof and formed so that a position of the engaging protrusion 43B of the metal component 40 is located under the cut portion 18 in the both of the width direction and the front direction.

As shown in FIG. 2(B), the upper wall 11 includes a tapered surface 18D at a position the oblique edge 18B is located. The upper wall 11 also includes a flat conductive member entry groove 19 extending in the front direction from the front end edge 18C of the cut portion 18. Further, the upper wall 11 includes a tapered surface 19C inclining downward in an inner surface thereof at a transition portion from the cut portion 18 to the flat conductive member entry groove 19.

The pressing member 50 is made from the electrical insulating material as well as the housing 10, having a lever style and extending in the terminal aligning direction. The pressing member 50 is supported so as to rotate between the open position allowing the flat conductive member P to be inserted and the closed position pressing the contact portion 24A of the terminal 20 against the flat conductive member P. In FIG. 2, the pressing member 50 is shown at the open position.

The pressing member 50, as shown in FIG. 2(A), is located in a space cut and opened widely at the front end edge of the upper wall 11 of the housing 10 and supported so as to rotate, by an axis portion (not shown) formed at an either end of the connector 1 in the width direction and the cam portion 51 provided at a corresponding position to the first terminal 20. The cam portion 51 is laid in an insular way in a groove portion 52 formed at a lower end portion of the pressing member 50, connecting an inner surfaces of the groove portion 52 next to each other. The groove portion 52 forms spaces at both of an upper and a lower ends of the cam portion 51, for containing the pressed arm portion 25 of the upper arm portion 21 of the terminal 20 and the cam supporting portion 28 of the lower arm portion 22 of the terminal 20 in a penetrating state, respectively.

The cam portion 51 has a horizontally long sectioned shape at the open position, as shown in FIG. 2(A). A vertical length of the cam portion 51 is slightly shorter than a distance between the pressed portion 25A of the upper arm portion 25 and the cam supporting portion 28, while a horizontal length of the cam portion 51 is slightly longer than the distance between the pressed portion 25A of the upper arm portion 25 and the cam supporting portion 28.

As shown in FIG. 2(A), the cam portion 51 has a rounded shape at an upper left corner and a lower left corner thereof, while having an angled shape at an upper right corner and a lower right corner thereof. The cam portion 51 is also formed in the same way described above, at a corresponding position to the second terminal 30.

The pressing member 50 further includes a groove portion 53 and a supporting portion 54 at a corresponding position to the metal member 40 located outside of the terminal at either end in the width direction of the connector 1. The supporting portion 54 is similar to the cam portion 51. As shown in FIG. 2(A), the supporting portion 54 has a vertically long rectangular shape. A vertical length of the supporting portion 54 is nearly equal with a distance between a lower end of the supporting arm 44 of the metal component 40 and an upper surface of the lower wall 12 of the housing 10 while a horizontal direction of the supporting portion 54 is shorter than the distance between a lower end of the supporting arm 44 of the metal component 40 and the upper surface of the lower wall 12 of the housing 10. The supporting portion 54 has a rounded shape at an upper left corner and a lower left corner thereof, while having an angled shape at an upper right corner and a lower right corner thereof. The supporting arm 44 of the metal component 40 penetrates through the groove portion 53 along with an upper edge of the supporting portion 54.

Also shown in FIG. 2(A), the pressing portion 50 includes an operating portion 55 protruding upward than the upper wall 11 of the housing 10 at an upper end side thereof.

Hereunder, a way to use of the connector in the embodiment will be described.

(1) First, the connector 1 is mounted on the circuit board (not shown) thereby connecting the first and the second terminal 20 and 30 to corresponding circuit portions on the circuit board. More specifically, the first and second terminals 20 and 30 are soldered to the corresponding circuit portions at the contact portions 27 and 37 thereof, respectively. In addition, the metal component 40 is soldered to a corresponding portion of the circuit board.

(2) The pressing member 50 is at the open position with the operating portion 55 facing in an upward direction. In this state, a space between upper arm portion 21 and the lower arm portion 22 of the first terminal 20 is opened freely at the receptacle portion 10A of the housing 10, thus it is possible to receive easily the flat conductive member P. As for the second terminal 30, it is also possible to receive the flat conductive member P.

(3) Next, as shown in FIGS. 1 and 3(A), the flat conductive member P is moved in the direction of the arrow A and inserted into the receptacle portion 10A from front end portion thereof. The flat conductive member P can be easily inserted into the space between the upper arms and the lower arms at a position the first and second terminals 20 and 30 are located in the width direction. On the other hand, at a position the metal components 40 is located, as shown in FIG. 3(B), since the engaging protrusion 43B of the metal component 40 protrudes largely, the flat conductive member P deforms upward by a large amount as the edge portion P2 for engaging moves over the engaging protrusion 43B from the rear edge thereof having a tapered shape. The deformation of the edge portion P2 is accepted sufficiently with an opening of the cut portion 18 formed in the upper wall 11 of the housing 10. Accordingly, the edge portion P2 can be inserted further in the front direction moving over the engaging protrusion 43B in a state that the edge portion P2 deforms. As shown in FIG. 3(C), when the edge portion P2 passes over the engaging protrusion 43B, the flat conductive member P returns into a flat shape released from the deformation, and further goes into the flat conductive member entry groove 19 of the housing 10, where the flat conductive member P is supported. As a result, a rear end of the edge portion P2 for engaging engages the front edge of the engaging protrusion 43B when the flat conductive member P is pulled in the rear direction. Thereby, it is possible to prevent the flat conductive member P from coming off.

(4) When it starts to insert the flat conductive member P into the receptacle portion 10A, the flat conductive member P can be inserted easily with the tapered surface 18D of the receptacle portion 10A. Further, when the edge portion P2 passes the cut portion 18, the flat conductive member P proceeds being guided by and having a sliding contact with the oblique edge 18B at an upper surface of the deformed edge portion P2, as well as being guided by and having a sliding contact with the tapered surface 19C of the inner surface of the upper wall 11 at the lower side thereof. Consequently, the flat conductive member P proceeds further being guided so as to transform from a deformed shape to the flat shape. Thereby, the front end portion of the flat conductive member P is smoothly inserted into the flat conductive member entry groove 19.

(5) After the edge portion P2 has engaged with the engaging protrusion 43B as described above, the pressing member 50 is rotated from the open position as shown in FIG. 4(A) to the closed position as shown in FIG. 4(B). When the pressing member 50 is rotated as described above, the cam portion 51 rotates into a vertically long shape and presses the pressed portion 25A of the first terminal 20 upward, thereby lifting the pressed arm portion 25 in the upper direction. Accordingly, the upper arm portion 21 of the first terminal 20 deforms elastically around the combining portion 23 as the pivot thus the contact arm portion 24 deforms obliquely in the lower direction. As a result, the flat conductive member P is pressed downward by the contact portion 24A of the contact arm portion 24, thereby increasing a contact pressure thereof against the first terminal 20.

When the flat conductive member P includes the connection circuit portion on an upper surface thereof, the connection circuit portion contacts with the contact portion 24A. On the other hand, when the flat conductive member P includes the connection circuit portion on a lower surface thereof, the contact pressing portion 26A of the lower arm portion 22 functions as a contact portion. It is obvious that the connection circuit portions can be connected to the both of the contact portion 24A and the contact pressing portion 26A when the connection circuit portions are located on both surfaces of the upper and lower surfaces of the flat conductive member P. As for the second terminal 30, the flat conductive member P is also connected using the pressing member 50 in the same way described above.

(6) In the embodiment, as described above, it is possible to prevent securely the flat conductive member from coming off by simply inserting into the receptacle portion, since the edge portion for engaging engages with the engaging portion when the flat conductive member receives a force in the rear direction. Because the flat conductive member deforms automatically as the edge portion abuts against the engaging protrusion and moves over the engaging protrusion. After passing over the engaging protrusion, the flat conductive member is released automatically from the deformation and returns into the flat shape.

(7) As described above, when the pressing member is at the closed position, the flat conductive member is pressed downward by the contact portion of the terminal. Accordingly, the edge portion for engaging of the flat conductive member can always engage with the engaging protrusion, being unable to move upward. On the other hand, when the flat conductive member is pulled out, the contact portion deforms upward with the pressing member at the open position. As a result, the edge portion can come off easily from the engaging protrusion as the flat conductive member is tilted upward, thereby extracting the flat conductive member by pulling in the rear direction.

Not limited to the embodiment described above, in the present invention, it is possible to vary in many ways. For example, the engaging protrusion can be on the lower wall of the housing, instead of the metal component. Therefore, it is possible to reduce a number of components since the metal component is unnecessary. In this case, it is preferred that the engaging protrusion has a sufficient size to obtain strength equivalent to the case that the engaging protrusion is included in the metal component.

It is also preferred that the engaging protrusion is arranged so that a distance between the engaging protrusion and the upper wall of the housing is smaller than a thickness of the flat conductive member. The flat conductive member does not come off from the engaging protrusion after the edge portion passes over the engaging protrusion, even the flat conductive member is wobbled in a thickness direction thereof.

Furthermore, as shown as a projected line in FIG. 1(A), the cut portion 18 may have an approximate V character shape with the oblique edge extending to a front portion. Thereby the oblique edge can guide the edge portion of the flat conductive member certainly to the forward portion.

In the present invention, the edge portion of the flat conductive member is not limited to a shape shown in FIG. 1(A), as far as the edge portion can engage with the engaging protrusion when being pulled in the rear direction. For example, the edge portion may have a shape with side edges extending straightly at the rear side thereof, without the narrow portion P1 right at the rear side thereof as shown in FIG. 1(A). The edge portion also may protrude obliquely from the side edges instead of protruding at a right angle.

The disclosure of Japanese Patent Application No. 2008-113310, filed on Apr. 24, 2008 is incorporated in the application by reference.

While the invention has been explained with reference to the specific embodiments of the invention, the explanation is illustrative and the invention is limited only by the appended claims.

What is claimed is:

1. An electrical connector to be connected to a flat conductive member, comprising:

a housing including an upper wall and a lower wall, said housing further including a receptacle portion between the upper wall and the lower wall for receiving the flat conductive member, said upper wall including a cut portion;

a terminal including a contact portion for contacting with the flat conductive member; and an engaging protrusion for engaging the flat conductive member, said engaging protrusion being situated under the cut portion so that an edge portion of the flat conductive member moves over the engaging protrusion and deforms into the cut portion when the flat conductive member is inserted into the receptacle portion.

2. The electrical connector according to claim 1, further comprising a metal member attached to the housing, said engaging protrusion being formed in the metal member.

3. The electrical connector according to claim 1, wherein said engaging protrusion is formed on the lower wall.

4. The electrical connector according to claim 1, wherein said cut portion includes an oblique edge inclined relative to a direction that the flat conductive member is inserted into the receptacle portion.

5. The electrical connector according to claim 1, wherein said cut portion includes a tapered surface.

6. The electrical connector according to claim 1, wherein said engaging protrusion is arranged so that a distance between the engaging protrusion and the upper wall is smaller than a thickness of the flat conductive member.

7. The electrical connector according to claim 1, wherein said cut portion has a V character shape in a plan view.

8. The electrical connector according to claim 1, wherein a fitting portion is connected to a held portion at a position near the terminal holding wall so that the fitting portion deforms elastically with a portion of the held portion away from the fitting portion thereof as a pivot.

9. The electrical connector according to claim 1, further comprising a pressing member for pressing the terminal against the flat conductive member.

* * * * *